United States Patent [19]

Deutsch

[11] 4,300,434

[45] Nov. 17, 1981

[54] APPARATUS FOR TONE GENERATION WITH COMBINED LOUDNESS AND FORMANT SPECTRAL VARIATION

[75] Inventor: Ralph Deutsch, Sherman Oaks, Calif.

[73] Assignee: Kawai Musical Instrument Mfg. Co., Ltd., Hamamatsu, Japan

[21] Appl. No.: 150,493

[22] Filed: May 16, 1980

[51] Int. Cl.[3] ..... G10H 1/02

[52] U.S. Cl. ..... 84/1.19; 84/1.27; 84/1.01

[58] Field of Search ..... 84/1.01, 1.19, 1.22, 84/1.23, 1.24, 1.27

[56] References Cited

U.S. PATENT DOCUMENTS

| | | | |
|---|---|---|---|
| 3,908,504 | 9/1975 | Deutsch | 84/1.27 |
| 4,122,742 | 10/1978 | Deutsch | 84/1.19 |
| 4,175,464 | 11/1979 | Deutsch | 84/1.19 |
| 4,192,210 | 3/1980 | Deutsch | 84/1.01 |
| 4,214,503 | 7/1980 | Deutsch | 84/1.27 |
| 4,249,448 | 2/1981 | Deutsch et al. | 84/1.23 |

*Primary Examiner*—J. V. Truhe
*Assistant Examiner*—Forester W. Isen
*Attorney, Agent, or Firm*—Ralph Deutsch

[57] ABSTRACT

In a musical instrument having one or more tone generators in which a plurality of data words corresponding to the amplitudes of a corresponding number of evenly spaced points defining the waveform of one cycle of an audio signal are transferred sequentially from a note register to a digital-to-analog converter in repetitive cycles at a rate proportional to the pitch of the tone being generated, apparatus is provided for varying the spectral content of the tone in response to control signals. A loudness control signal causes loud tones to be produced with a greater number of harmonics than those for a soft tone. A formant control signal also causes the tones to have a time variant spectral quality.

11 Claims, 7 Drawing Figures

APPARATUS FOR TONE GENERATION WITH COMBINED LOUDNESS AND FORMANT SPECTRAL VARIATION

BACKGROUND OF THE INVENTION

1. Field of the Invention

This invention relates broadly in the field of electronic musical tone generators and in particular is concerned with apparatus whereby a loudness signal in combination with a formant control signal produces tones with time variant spectral characteristics which are selected in response to the loudness signal.

2. Description of the Prior Art

An elusive goal in the design of electronic musical instruments is the ability to realistically imitate the sounds of conventional acoustic type musical instruments. The best results have been obtained for electronic musical instruments which imitate wind-blow pipe organs and harpsichords. The principal reason for obtaining good imitative results for these instruments is that they are essentially mechanical tone generators. The tone generation is automatic and the musician only actuates on-off switches. With the notable exception of these two instruments, the tone character of almost all other musical instruments is a function of certain skills possessed by the musician.

It has long been recognized that with the notable exception of conventional organ tones, almost all tones from musical instruments exhibit tone spectra which are time variant. The recognition of the characteristic time variant spectra has motivated the development of electronic musical generating systems such as those known by the generic names of "sliding formant" and "FM-synthesizer." Sliding formant tone generators constitute a class of generators which are also called subtractive synthesis. In subtractive synthesis, the fundamental tone source generates more than the desired tone spectral components and the undesired spectral components are attenuated, or filtered out, by means of some variety of frequency filter. The FM-synthesizer is of the additive variety in that FM (frequency modulation) is used to add components to a source signal which often consists of a simple single frequency sinusoid time function.

The imitation of acoustic orchestral musical instruments using synthesis techniques such as the sliding formant or FM-synthesizer has been of the trial and error variety. One adjusts a multiplicity of tone controls and ADSR envelope controls until an output tone is produced which is judged to be "near to" or imitative of some particular preselected musical instrument. These techniques are distinctly different from the more academic procedure in which one first analyzes the tones from a selected musical instrument, then constructs an analytical model of the tone generator, and finally uses the experimentally obtained parameters in the analytical model to synthesize tones that closely imitate the original.

The academic approach of analysis, modeling, and synthesis for musical instrument sounds is obviously not an easily implemented technique judging from the current lack of success except in a few relatively isolated instances. Part of the problem rests in the inability to adequately model many of the subtleties in tone structure imparted by the musician in an effective performance on his instrument. The musician commonly uses a technique such that the tonal structure for a given musical note varies with the loudness of the tone. Repeated notes are played with different loudness and tonal structure and this subtle difference removes the mechanical-like repeated tones produced by most electronic musical tone generators. Even very expert players are unable to repeat a given tone with precisely an identical tone spectra. In general, as the tone level becomes louder, the tone spectra increases in the number and strength of the higher harmonics. Very soft tones tend to approach tones having only a few harmonics.

To compound the problem of imitating musical instruments is that even a sustained tone does not have a constant tone spectra. For almost all instruments it is well-known that the spectrum will change with time and with the tone's instantaneous amplitude envelope. Such time variant spectral variations are introduced in electronic musical instruments using synthesis techniques such as the sliding formant and FM-synthesizer.

In the copending patent application Ser. No. 139,908 filed Apr. 14, 1980 entitled "A Polyphonic Tone Synthesizer With Loudness Spectral Variation" a system is disclosed whereby a loudness control system is used to vary the spectral content of generated musical tones. The referenced patent application and the present invention are assigned to the same assignee. The invention disclosed in the application describes means for causing a tone generator of the type described in U.S. Pat. No. 4,085,644, entitled "Polyphonic Tone Synthesizer," to produce musical tones having spectral components which can be made to be time variant in response to a control signal such as the note's ADSR envelope function or the setting of a loudness control.

In a Polyphonic Tone Synthesizer of the type described in the referenced patent, a computation cycle and a data transfer cycle are repetitively and independently implemented to provide data which are converted into musical waveshapes. During the computation cycle a master data set is generated having a spectral content which is variable in response to an input spectral control signal. This is accomplished by utilizing a table of stored sinusoid values to address data values from a transform memory which contains a preselected set of data points. The sinusoid function values are scaled in magnitude in response to the input spectral control signal thereby causing a variable subset of the transform memory contents to be read out and stored in a main register. These computations are executed at a fast rate which may be nonsynchronous with any musical frequency.

Following a computation cycle, a transfer cycle is initiated during which the master data set is first adjusted to have a zero average value and is then transferred to selected members of a multiplicity of note registers. The data residing in the note registers are read out under control of note clocks having frequencies corresponding to the assigned corresponding keyboard switches. This data is read out sequentially and repetitively and converted to analog musical waveshapes. Tone generation continues uninterrupted during the computation and the transfer cycles.

An objective of the present invention is to provide a means of generating the data stored in the transform memory using preselected sets of harmonic coefficients during a subsequence of the computation cycle.

It is well-known in the musical tone generation art that time variant spectral variations of tones produce desirable tonal effects. These tonal effects range from imitations of musical instruments to novel tones having no imitative parents. The usual method of producing such spectral variations is to use the sliding formant techniques. This technique is usually implemented by using a frequency-domain filter with controllable cut-off frequencies to process waveshapes generated by analog musical instruments.

A different type of sliding formant tone generation is described in U.S. Pat. No. 3,908,504 entitled "Harmonic Modulation And Loudness Scaling In A Computer Organ" and in the previously referenced U.S. Pat. No. 4,085,644. In these systems the time variation of spectral content is obtained by varying the magnitude of harmonic coefficients used to compute waveshape amplitude points by means of a Fourier-type algorithm. The tonal effects obtained by "sliding" the magnitude of selected harmonic coefficients are very similar to tonal effects obtained by "sliding" the cut-off frequencies of a frequency domain filter.

An application of nonlinear system transformations in the generation of musical sounds is contained in the technical article: Beauchamp, J., "Brass Tone Synthesis by Spectrum Evolution Matching with Nonlinear Functions." *Computer Music Journal,* Vol. 3, No. 2, pp 35-42 (1979).

SUMMARY OF THE INVENTION

In a Polyphonic Tone Synthesizer of the type described in U.S. Pat. No. 4,085,644 a computation cycle and a data transfer cycle are repetitively and independently implemented to provide data which are converted to musical waveshapes. During the computation cycle a master data set is created and stored in a main register. The computations are executed at a fast rate which may be nonsynchronous with any musical frequency. At the end of a computation cycle the master data set is stored in a main register.

Following a computation cycle a transfer cycle is initiated in which the master data set is first adjusted to have a zero average value and is then transferred to preselected members of a multiplicity of note registers. Tone generation continues uninterrupted during the computation and transfer cycles.

The data points residing in the individual note registers are read out repetitively and sequentially at rates corresponding to actuated keyboard switches and transferred to a digital-to-analog converter which converts the input digital data into analog voltages producing the desired musical tones.

The computation cycle is divided into two consecutive subcomputation cycles. During the first subcomputation cycle a set of transfer data values are generated from a preselected set of harmonic coefficient values. The generated transfer data sets are stored in a transfer memory. During the second subcomputation cycle, a table of stored sinusoid values are sequentially accessed and used to address data values stored in the transfer memory. These addressed values comprise the master data set which is stored in the main register.

It is an object of the invention to provide a means for generating the transfer data sets such that the master data set generated by addressing values in response to a sinusoid addressing function will have a spectrum corresponding to preselected sets of harmonic coefficients.

It is a second object of this invention to produce musical tones having spectral components that vary in response to a loudness control signal. This response is accomplished by scaling the magnitude of the sinusoid addressing values in response to the loudness control signal which causes a variable subset of the transform memory contents to be read out and stored in the main register.

It is a further object of this invention to produce musical tones having spectral components that vary in response to a loudness control signal and which for any selected loudness signal value also provides the combination of time-variant tone spectrum values of the sliding formant variety. The time-variant spectral variations are obtained by appropriate scaling of the harmonic coefficients used in the first computation cycle subsequence in response to values of control signals.

BRIEF DESCRIPTION OF THE DRAWINGS

The detailed description of the invention is made with reference to the accompanying drawings wherein like numerals designate like components in the figures.

DETAILED DESCRIPTION OF THE INVENTION

Figure 1:
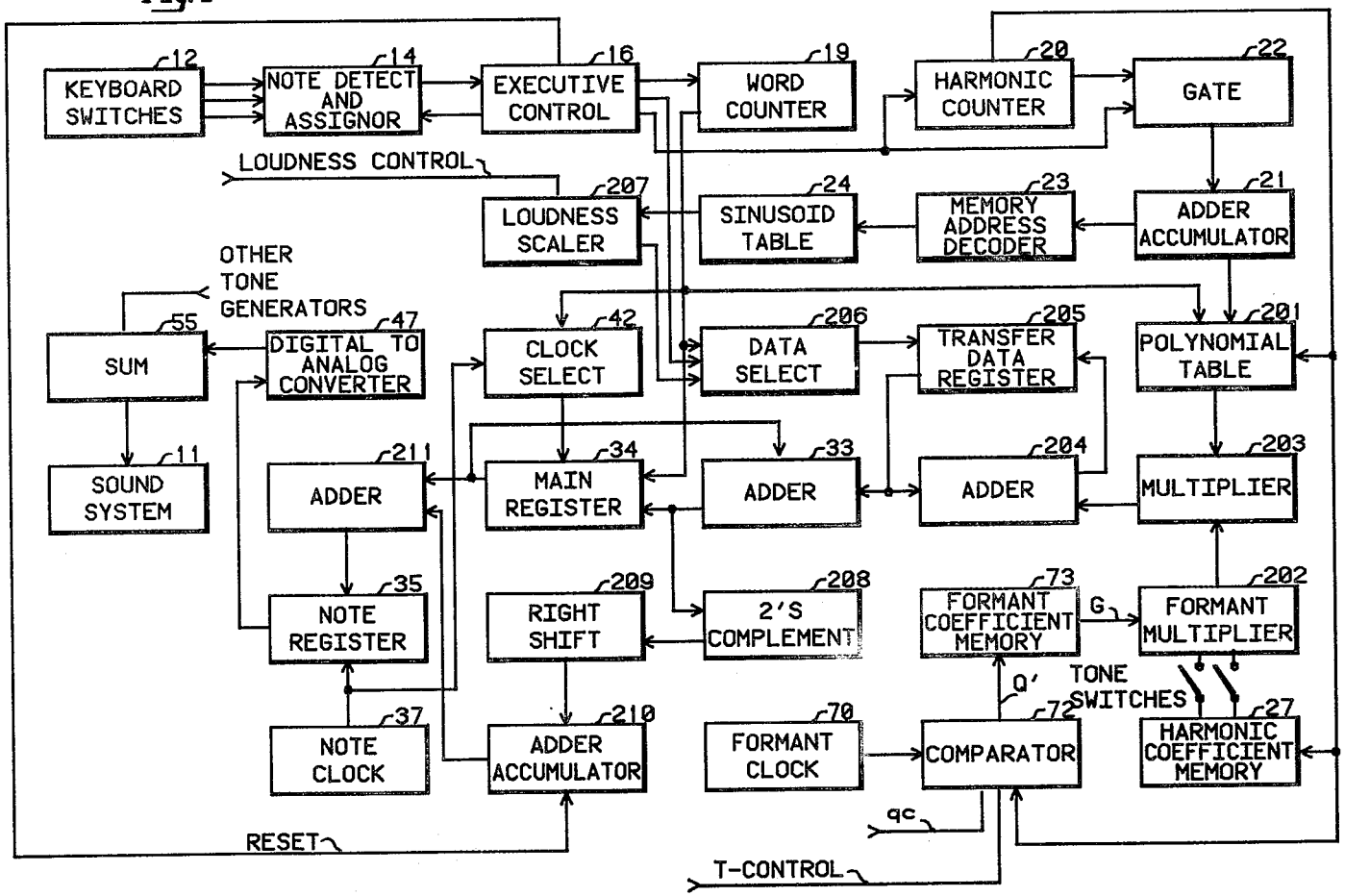
FIG. 1 is a schematic block diagram of an embodiment of the invention.

FIG. 1 shows an embodiment of the present invention which is shown and described as a modification to the system described in detail in U.S. Pat. No. 4,085,644 entitled "Polyphonic Tone Synthesizer" which is hereby incorporated by reference. All two-digit reference numbers used in the drawings correspond to the similarly numbered elements in the disclosure of the above-identified patent.

As described in the referenced patent, the Polyphonic Tone Synthesizer includes an instrument keyboard 12 which, for example, corresponds to the conventional keyboard of an electronic musical instrument such as an electronic organ. By depressing one or more keys on the instrument keyboard, a note detect and assignor circuit 14 stores the note information for the keys that have been actuated and assigns each actuated note to one of twelve separate tone generators. A note detect and assignor circuit is described in U.S. Pat. No. 4,022,098 which is hereby incorporated by reference. When one or more keys has been depressed, an executive control circuit 16 initiates a computation cycle during which a master data set consisting of 64 words is computed and stored in a main register 34. The 64 words are generated with values which correspond to the amplitudes of 64 equally spaced points for one cycle of the musical waveform to be created by the tone generators. The general rule is that the number of harmonics in the tone spectra cannot exceed one-half of the number of data points corresponding to one complete cycle of the waveshape.

As data furnished at the output of adder 33 is sent to be stored in the main register 34 it is also converted to a binary 2's complement form by means of the 2's complement 208. The output data from the 2's complement 208 is divided by 64 by means of the right shift 209 which performs a right shift of 6 binary bit positions on the input data. The output data from right shift 209 is added successively to the contents of the accumulator contained in the adder-accumulator 210. The accumulator is initialized at the start of a computation cycle under command of a RESET signal furnished by the executive control 16. The net result is that at the end of a computation cycle, the accumulator contains a value equal to the negative of the average value of the data values contained in the master data set stored in the main register 34.

At the completion of a computation cycle, the executive control 16 initiates a transfer cycle during which the master data set stored in the main register 34 is read out to the adder 211 and added with the contents of the accumulator in the adder-accumulator 210. The summed data is transferred to a note register 35 in one of the assigned tone generators. The net result is that the transferred data will constitute a translated master data set which has a zero average value.

The note register 35 stores the 64 data words of the translated master data set which corresponds to one complete cycle of the musical tone to be generated. These data points are read out of the note register 35 repetitively and sequentially and transferred to a digital-to-analog converter 47 which converts the input digital data into an analog voltage of the desired musical waveshape. The analog signals from other tone generators are combined in sum 55 and the combined signal is applied to a sound system 11 to be converted into audible sounds.

The data points are transferred out of the note register 35 at a clock rate generated by an associated note clock 37. There is a note clock associated with each of the tone generators. The note clock can be implemented as a voltage controlled oscillator whose frequency is set at 64 times the fundamental musical frequency of the associated keyed note on the keyboard. In this fashion all 64 waveshape data points are transferred to the digital-to-analog converter 47 in a time interval corresponding to one period of the pitch, or fundamental frequency, of the selected note.

There are a variety of methods available for implementing the voltage controlled oscillator used for the note clock 37. One such method is described in detail in U.S. Pat. No. 4,067,254 entitled "Frequency Number Controlled Clocks" which is hereby incorporated by reference.

As further described in the above-identified U.S. Pat. No. 4,085,644 it is desirable to be able to continuously recompute the master data set which resides in the main register 34 during a sequence of computation cycles and to reload this data in the note register 35 while the associated key on the keyboard remains depressed. This is accomplished without interrupting the flow of data points to the digital-to-analog converter at the note clock rate.

While the circuitry for only one tone generator is shown explicitly in FIG. 1, it will be understood that twelve such tone generators including twelve assocated note clocks are normally provided in the preferred embodiment of the Polyphonic Tone Synthesizer. A tone generator comprises a note register, note clock, and a digital-to-analog converter. The note generators are supplied values of the translated master data set of the end of each computation cycle of a sequence of computation cycles.

Each computation cycle is divided into a first subcomputation cycle and a second subcomputation cycle which follows the first subcomputation cycle. During the first subcomputation cycle a set of transfer data values are generated and stored in the transfer data register 205. During the second subcomputation cycle a master data set is generated by addressing a selected subset of values from the data stored in the transfer data register 205. The master data set is stored in the main register 34.

The transfer data values Z(N) stored in the transfer data register 206 are computed according to the relation $$Z(N) = \sum_{q=1}^{M} c_q T_q(N') \qquad \text{Eq.1}$$

$c_q$ are elements of a set of harmonic coefficients that are stored in the harmonic coefficient memory 27 and after being accessed are scaled in magnitude by the formant multiplier 202 in a manner described later. M is a preselected number that indicates the total number of harmonics to be used in evaluating the transfer data values. M is advantageously restricted to be no greater than one-half of the number of elements in the master data set. The symbol $T_q(N')$ denotes a Chebychev polynomial of the first kind with index q and argument N'.

$$N' = \cos(\pi N/32) \qquad \text{Eq.2}$$

where N is an integer in the range N=1, . . . , 64. N will correspond to the count states of the word counter 19.

The means for generating the values of the transfer data values Z(N) is analogous to that described in detail in the referenced U.S. Pat. No. 4,085,644 for generating a master data set using a generalized Fourier-type algorithm employing orthogonal polynomials. The Chebychev polynomials constitute a member of the class of orthogonal polynomials. The term orthogonal polynomial is used here in a generic sense to include both orthogonal polynomials and orthogonal functions.

Values of the Chebychev polynomials are stored in the polynomial table 201. For the case in which the master data set comprises 64 words corresponding to a maximum of 32 harmonics, the polynomial table is configured as a set of 32 addressable memories each of which contains 64 data words.

During the first subcomputation cycle, word counter 19 counts timing signals furnished by the system master logic clock modulo 64. The harmonic counter 20 and the word counter 19 are initialized at the start of the first subcomputation cycle by a signal furnished by the executive control 16. The harmonic counter 20 is incremented each time that the word counter 16 returns to its lowest count state.

The contents of the harmonic counter 20 are used to selectively address one of the 32 addressable memories contained in the polynomial table 32. The particular word in the memory chosen by the harmonic counter is selected by the state of the word counter 19.

The Chebychev polynomial data selected and addressed out from the polynomial table 201 is multiplied by a scaled value of a selected harmonic coefficient in the multiplier 203. The harmonic coefficients are stored in the harmonic coefficient memory 27 and values are addressed out in response to the contents of the harmonic counter 20.

During the first subcomputation cycle, the executive control 16 causes the data select 206 to transfer the contents of the word counter 19 to act as addressing data for the transfer data register 205. At each logic clock time, a data value is addressed out of the transfer data register at an address determined by the contents of the word counter 19. The addressed data values are added by the adder 204 to the product value generated by the multiplier 203. The summed value is then written into the transfer data register. The net result is that at the end of the first subcomputation the transfer data register 205 contains a set of values according to the relation given by Eq. 1.

The harmonic coefficients stored in the harmonic coefficient memory can be any set of values for producing selected musical tone colors or spectral content. Advantageously these can be selected to produce a desired tone for the maximum value of the loudness control signal and in the absence of any modification, or scaling, by the harmonic formant subsystem. The stored values of the harmonic coefficients are accessed out from the harmonic coefficient memory 27 during the first subcomputation cycle in response to the current value of the harmonic number q which is the state of the harmonic counter 20. The addressed harmonic coefficients are modified by the formant coefficients G in the formant multiplier 74 using a formant control system which is described in detail in the above referenced U.S. Pat. No. 4,085,644.

The current value of the harmonic number q, as determined by the state of the harmonic counter 20, is sent to the comparator 72. A selected value $q_c$ is an inut to the comparator 72. $q_c$ is the harmonic number that determines the effective cut-off harmonic number for a low-pass harmonic formant filter. $q_c$ is an input value to the formant system which can be supplied by any of a wide variety of numerical input data means. The formant clock 70 provides a prescribed timing means for providing a time varying value u as an input to the comparator 72. At each bit time of the first subcomputation cycle, comparator 72 compares the value of $q+u$ with the selected input value of $q_c$. If $q+u$ is less than or equal to $q_c$, a value $Q'=1$ is sent to the formant coefficient memory 73. If at some bit time it is found that $q+u$ is greater than $q_c$, the value $Q'=q+u-q_c$ is transmitted as a data address to the formant coefficient memory 73. In response to the received address, a formant coefficient G is accessed out from the formant coefficient memory 73. The formant multiplier 202 multiplies the current value addressed out from the harmonic coefficient memory by the value G to form a scaled harmonic coefficient.

The scaled harmonic coefficients from the output of the formant multiplier 202 are multiplied by the multiplier 203 with the orthogonal polynomial data values read out of the polynomial table 201.

The previously referenced U.S. Pat. No. 4,085,644 lists suitable values for the formant coefficients G stored in the formant coefficient memory 73.

The T-CONTROL signal applied to the comparator 72 is used to select either a low pass or high pass formant filter which can be implemented in the manner described in U.S. Pat. No. 4,085,644.

For a high pass operation selected by the T-CONTROL signal, at each bit time comparator 72 compares the value of $q+u$ with the selected input value of $q_c$. If $q+u$ is greater than or equal to the value of $q_c$, a value $Q'=1$ is sent to the formant coefficient memory 73. If at some bit time it is found that $q+u$ is less than $q_c$, then the value $Q'=q_c-(q+u)$ is transmitted as a data address to the formant coefficient memory 73.

Instead of using a stored table of formant coefficients it is an obvious modification to use logic circuitry for calculating values of the formant coefficient G in response to the output signal data from the comparator 72. For example, it has been found that a useful set of coefficients can be calculated from the relation $$G=exp\{0.1151\times 40\log_{10}[8/(7+q)]\} \qquad Eq.\ 3$$

After the termination of the first subcomputation cycle, the second subcomputation cycle is initiated. During the second subcomputation cycle the executive control 16 instructs the data select 206 to transfer the output from the loudness scaler 207 to address data values out of the transfer data register 205.

In the second subcomputation cycle, the computation subcycle is limited to 64 clock times during which the word counter 19 is incremented for 64 count states while the harmonic counter 20 remains at its initial count state of unit value.

The cosine values accessed out from the sinusoid table 24 are scaled in magnitude by the loudness scaler 207 and the scaled values are used to address stored data from the transfer data register 205. The loundess scaler 207 is a data value multiplier in which the multiplier value is varied in response to the LOUDNESS CONTROL signal. This signal can be obtained from a variety of sources depending upon the desired musical effect. Such sources include touch responsive keyboard switches, pressure sensitive keyswitches in which the signal output of the pressure sensor varies with the pressure exerted on the closed keyswitch, the signal output from an ADSR envelope generator, and loudness compensation data.

A method of obtaining a loudness control signal is described in the patent application Ser. No. 019,318, now U.S. Pat. No. 4,214,503, entitled "Electronic Musical Instrument With Automatic Loudness Compensation" and filed Mar. 9, 1979. This application has a common assignee with the present invention.

For a measure of added realism, a random signal can be added to the loudness control signal so that repeated notes will always differ in spectral content from each other even if the steady state control signal does not change.

Data is addressed out of the main register 34 in response to the contents of the word counter 19 during the second subcomputation cycle. This addressed data is added by adder 33 to the corresponding data addressed out from the transfer data register 205. The summed value is then written into the main register 34. The net result is that a master data set resides in the main register 34 at the end of the second subcomputation cycle.

The addressing data input to the transfer data register 205 contains an internal memory address decoder. This decoder rounds off address data to the closest integer value corresponding to the 64 memory addresses storing the transfer data points.

The nonlinear data stored in the transfer data register 205 is used essentially to perform a nonlinear amplitude transformation on the sinusoid function data values addressed out from the sinusoid table 24 and scaled in magnitude by the loudness scaler 207. It is well-known in the signal theory art that if a signal is transformed by a nonlinear transformation then the result is an output signal that contains more frequency components than existed in the original signal. Discussions of nonlinear transformations can be found in the book; Deutsch, Ralph, *Nonlinear Transformation of Random Processes.* Prentice-Hall, Inc., 1962.

It is a property of the system shown in FIG. 1 that the maximum number of harmonics contained in a master data set cannot be greater than 32, or not greater than one-half of the number of equally spaced data points comprising one cycle of the generated musical tone. Thus, even with the nonlinear amplitude transformation, the total number of harmonics is limited and this characteristic of the present invention eliminates any requirement for any other means to limit or modify the spectral content following the nonlinear amplitude transformation.

The values of the unscaled harmonic coefficients $c_q$ are chosen to obtain a desired musical tone corresponding to the maximum value of the loudness control signal furnished to the loudness scaler 207. The harmonic coefficient memory 27 can contain a multiplicity of sets of harmonic coefficients which are selectively provided to the formant multiplier 202 by actuating the stop switches. These are also called tone switches.

While the harmonic coefficients can all have positive values, it is known that if the harmonic coefficients are multiplied by phase numbers $P_q$ then it is possible to maximize the RMS value of the computed data sets for a prescribed peak signal value limitation imposed by the number of binary bits in a digital word used to represent numerical values. The values of $P_q$ all have the values +1 or −1. The following set of values for $P_q$ are listed in the referenced U.S. Pat. No. 4,085,644 and have been experimentally verified to produce satisfactory results;

−1,−1,−1,−1,−1,−1,−1,−1,+1,+1,+1,−1,−1-
,−1,+1,+1
−1,−1,+1,+1,−1,+1,+1
−1,+1,−1,−1,+1,−1,+1,−1,+1
−1,−1,−1,−1,−1,−1,−1,−1,+1,+1,+1,−1,−1-
,−1,+1,+1
−1,−1,+1,+1,−1,+1,+1,−1,+1,−1,−1,+1,−1-
,+1,−1,+1.

The following alternative set of phase numbers $P_q$ have also been verified to produce satisfactory results:

+1,−1,+1,+1,+1,−1,−1,+1,+1,−1,+1,+1,+1-
,+1,+1,+1
+1,+1,−1,−1,+1,−1,+1,−1,−1,−1,+1,+1,−1-
,+1,−1,−1
+1,−1,+1,+1,+1,−1,−1,+1,+1,−1,+1,+1,+1-
,+1,+1,+1
+1,+1,−1,−1,+1,−1,+1,−1,−1,−1,+1,+1,−1-
,+1,−1,−1.

The use of the phase constants $P_q$ produces an improvement in the art of creating new frequencies by the use of nonlinear transformation of signals. As the cosine values addressed out from the sinusoid table 24 are reduced in magnitude by the loudness scaler 207, only a limited range of the data contained in the transform register 205 is accessed out. Thus the RMS value of the master data set will vary with changes in the loudness control signal. This action, fortunately, takes place in the proper musical direction in that softer tones will have fewer harmonics. It has been found that if all the phase constants $P_q$ have the same value, then for loudness scaler ranges of 20 db, the power level associated with the master data set can vary by about 40 db. If the $P_q$ have the values shown in the second set listed above, then the power level will only vary by about 20 db which is a significant improvement in permitting a large dynamic range in the loudness control signal without producing an intolerable decrease in the loudness of the tones generated from the master data set.

Because the cosine function is even symmetric about the value of argument $\theta=\pi$, the system shown in FIG. 1 can be operated in the even symmetric manner described in detail in the referenced U.S. Pat. No. 4,085,644. Thus only 32 points are required for the master data set. When this symmetric mode of operation is used, word counter 19 is made to count modulo 32 during the second subcomputation cycle. The right shift 209 performs a right shift of 5 binary bit positions corresponding to a division by the value 32. During a transfer cycle, data is addressed out of the main register 34 in a forward and reverse order as described in the referenced patent so that a complete data set of 64 points for a waveshape cycle is transferred to the note register 35.

Figure 2:
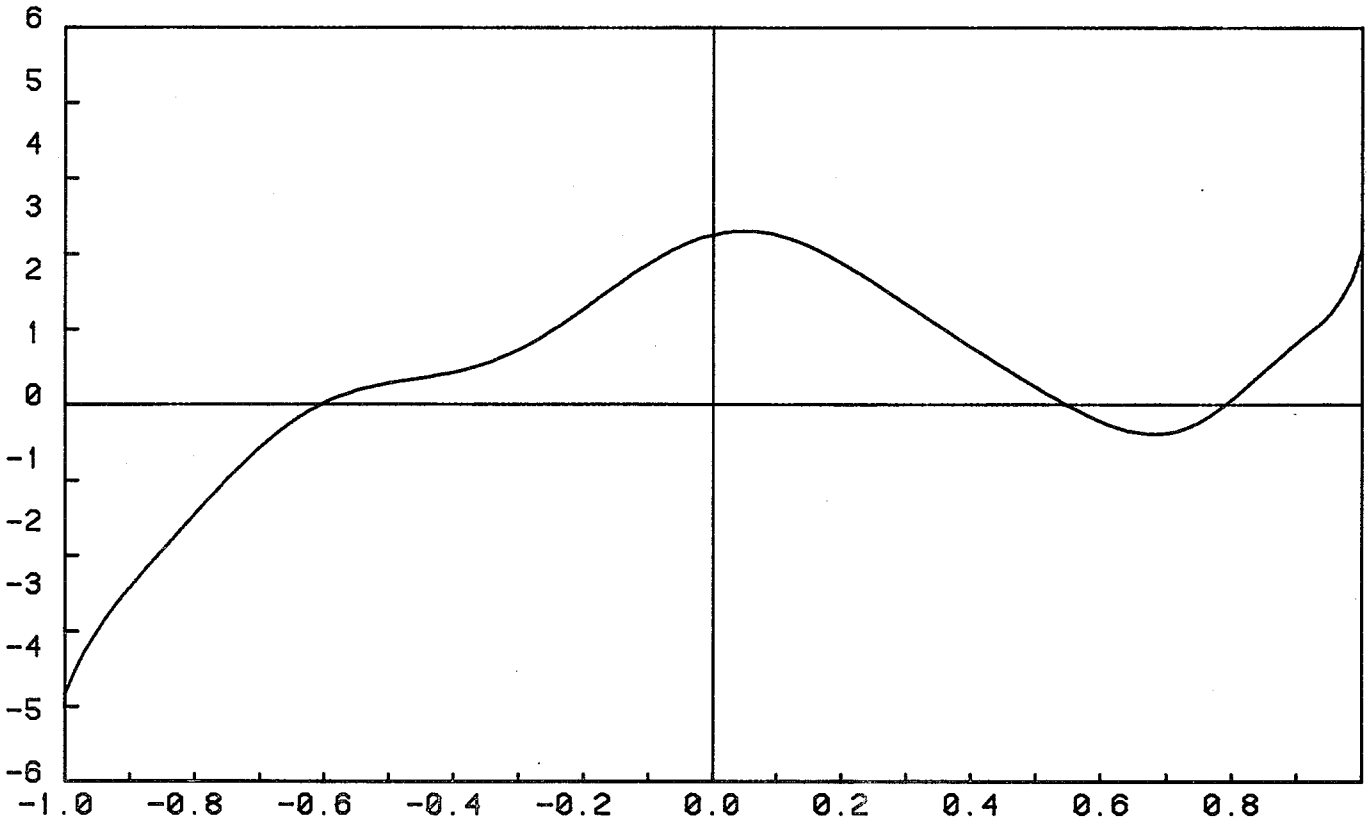
FIG. 2 is a graph of a nonlinear transformation.

FIG. 2 shows the plot of a transfer data set for the musical tone having the spectral components listed in Table 1.

TABLE 1

| Harmonic | DB | Harmonic coefficient (63 maximum) |
|---|---|---|
| 1 | 0 | +63 |
| 2 | −2 | −50 |
| 3 | −5 | +35 |
| 4 | −10 | +20 |
| 5 | −13 | +14 |
| 6 | −19 | −7 |
| 7 | −20 | −6 |
| 8 | −25 | +4 |
| 9 | −28 | +3 |
| 10 | −28 | −3 |
| 11 | −29 | +2 |
| 12 | −29 | +2 |
| 13 | −41 | +1 |
| 14 | −99 | 0 |
| 15 | −99 | 0 |

All the harmonic coefficients for harmonics 17 through 32 were selected to have zero value.

Figure 3:
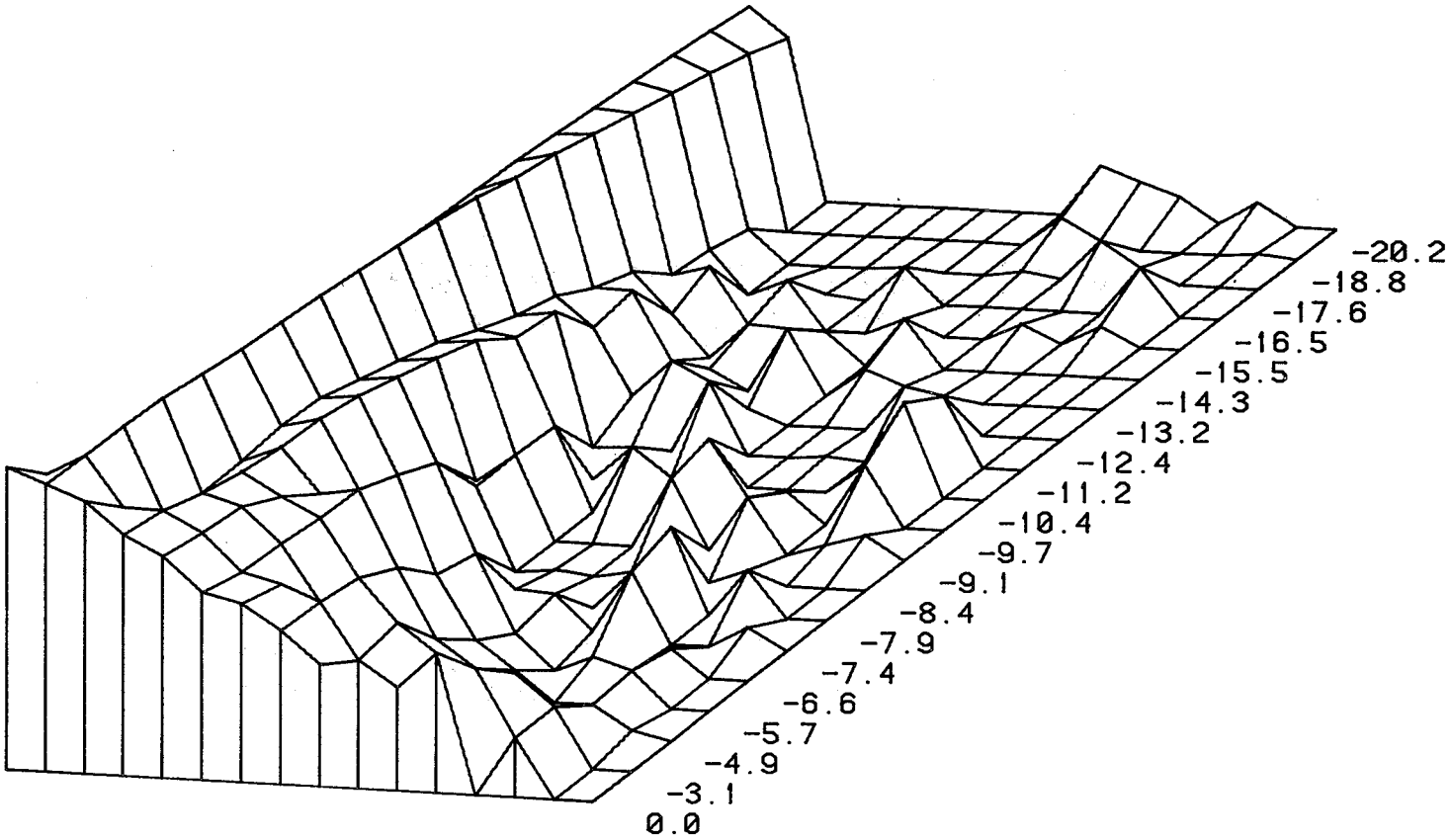
FIG. 3 is a three dimensional graph of the spectral variation produced in the output signal.

FIG. 3 shows a three-dimensional plot of the output signal to the sound system 11 of FIG. 1 using the data shown in FIG. 2 stored in the transform data register 205. The number on the right-hand end of each spectrum indicates the number of db attenuation of the cosine values made by the loudness scaler 207. The spectral plots have a maximum of 0 db and the base plane corresponds to −50 db.

Figure 4:
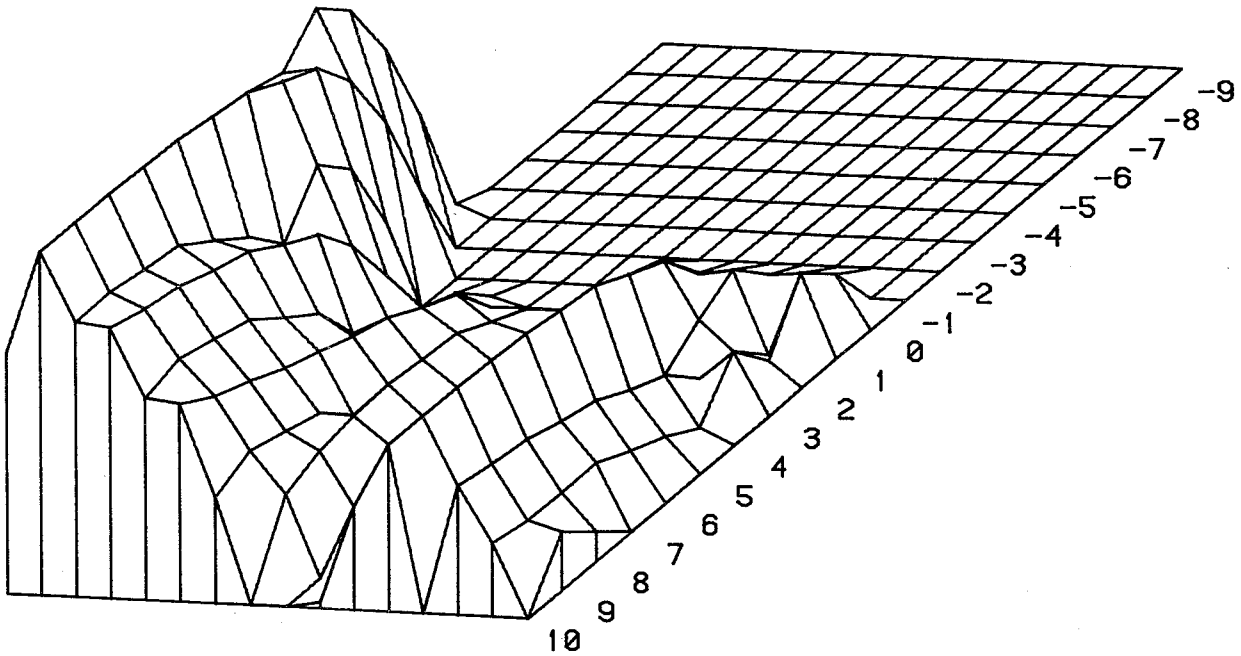
FIG. 4 is a three dimensional graph illustrating the action of the harmonic formant subsystem.

FIG. 4 is a three-dimensional plot of the output signal to the sound system 11 using the data shown in FIG. 2. The loudness scaler is at a constant −6 db level and the formant subsystem is started in the low-pass mode with an initial cut-off at the tenth harmonic. The cut-off is varied by one harmonic for each member of the family of curves.

Figure 5:
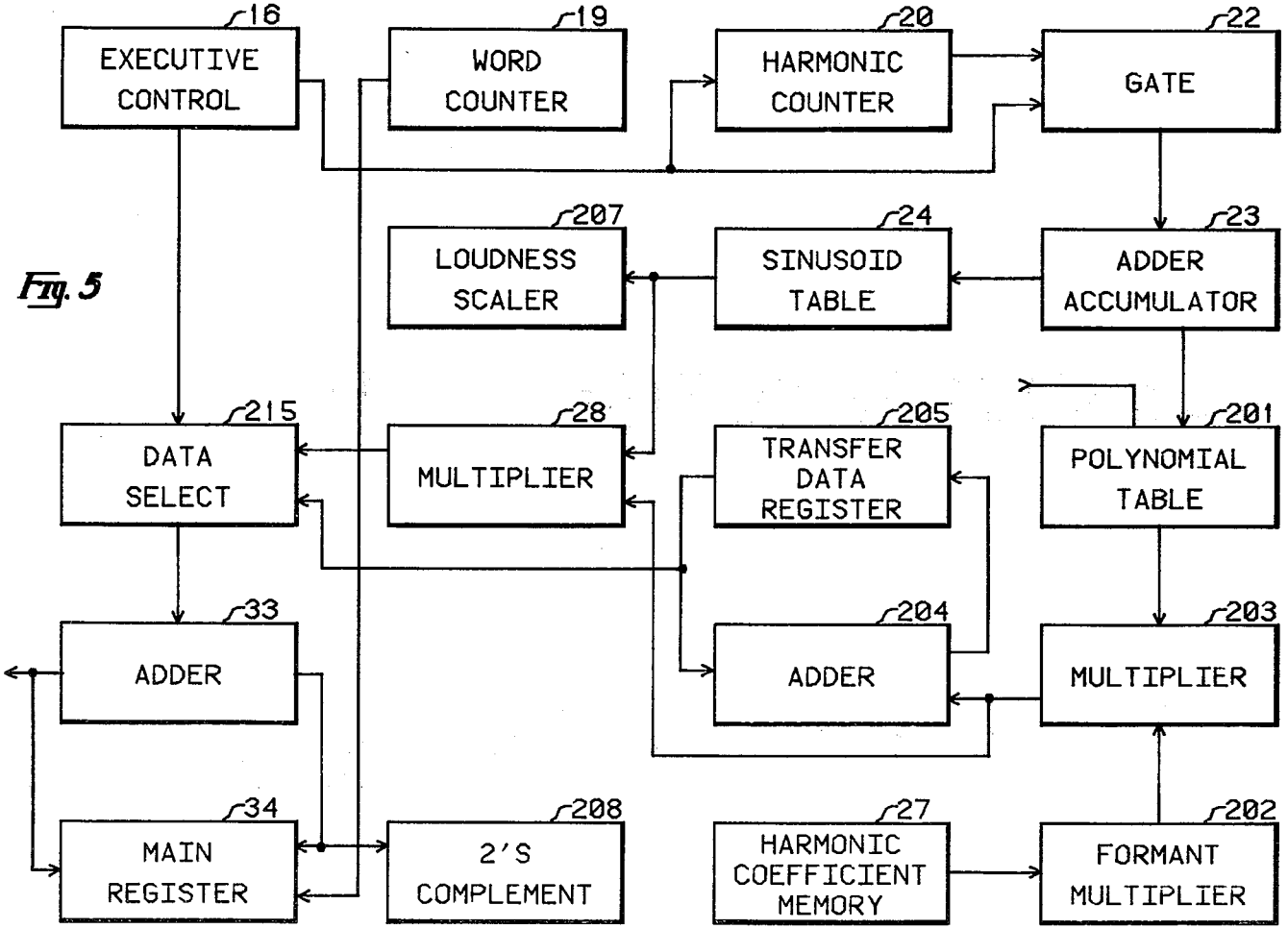
FIG. 5 is a schematic block diagrams of a combined tone generation system.

FIG. 5 shows a combined system in which the Polyphonic Tone Synthesizer can be operated selectively in either its conventional mode or in the mode having the combination of the loudness and formant tone variations.

When the nonlinear transfer generation mode of operation is not desired, a control signal is sent to the data select 215 by the executive control 16. In response to this signal the data select choses the output data from multiplier 28 instead of the output data accessed from the transfer data register 205. In this fashion the master data set can now be computed during the first subcomputation cycle in the manner described in the referenced U.S. Pat. No. 4,085,644. The subsystem, starting with the 2"s complement 208, does not have to be inhibited because it has no real action in the normal mode of operation for which the master data set always has a zero average value.

Figure 6:
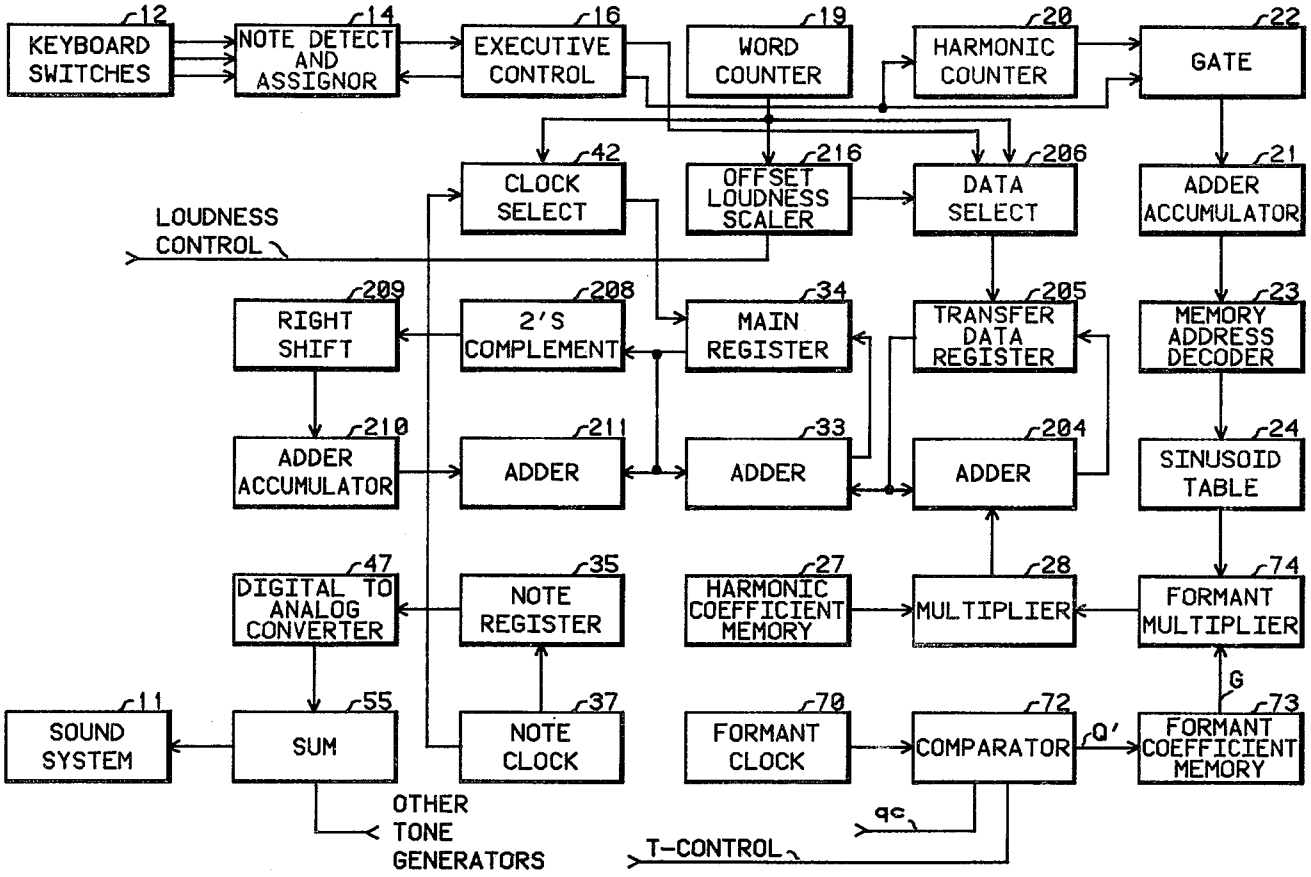
FIG. 6 is a schematic block diagram of an alternative embodiment of the invention.

The system shown in FIG. 1 used Chebychev polynomials primarily because the nonlinear transformation was selected to be a cosine function having an argument corresponding to the contents of word counter 19 for a given state of the harmonic counter 20. Other orthogonal polynomials or orthogonal functions can also be used with a corresponding change in the function of the word counter state used for addressing the transfer data register. An example of such an alternative system is shown in FIG. 6. In this system a conventional Fourier algorithm using trigonometric functions is used to construct the transfer data values which are later addressed out as a linear function of the master data set word addresses.

During the first subcomputation cycle 32 points of the transfer data set are computed using a conventional Fourier algorithm employing only trigonometric sine values which are stored in the sinusoid table 24. This action parallels that of a computation cycle for the master data set described in detail in the referenced U.S. Pat. No. 4,085,644. Only 32 points, corresponding to one-half of the transfer data set, are required for a tone generator system having the capability of creating musical tones having a maximum of 32 harmonics. The remaining 32 points for a sample waveshape period of evenly spaced points can be obtained by a reverse addressing of either the transfer data register 205 during the second subcomputation cycle or by reverse addressing the main register 34 when reading out stored data during a transfer cycle.

The word counter 19 states are used to address stored data from the transfer data register 205 during the second subcomputation cycle. These counter state values are scaled in the offset loudness scaler 216 in response to the loudness control signal. The remainder of the system shown in FIG. 6 functions in the manner previously disclosed in connection with the system shown in FIG. 1.

The tone spectra obtained with the systems shown in FIG. 1 and FIG. 6 will not be the same even if identical sets of harmonic coefficients are used. These differences are a manifestation of the characteristic of using different nonlinear transformation to generate the master data sets. While the two systems can be made to have the same tone for a single set of harmonic coefficients, a given loudness scaling, and a given harmonic formant shape, all other combinations of values will produce different tonal colors (spectra) for the two systems.

Figure 7:
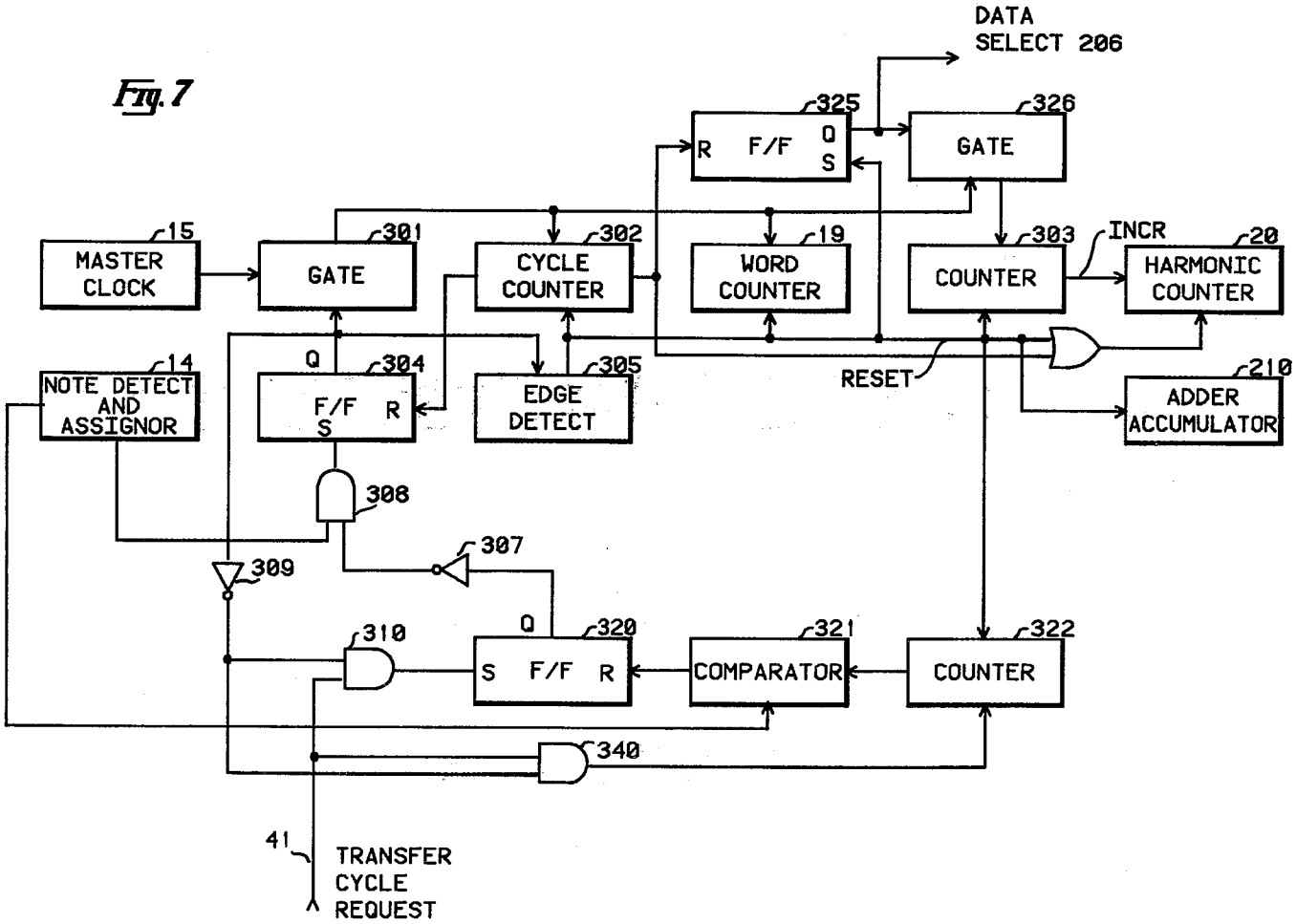
FIG. 7 is a schematic diagram showing details of the executive control.

FIG. 7 shows details of the executive control 16. The system elements in FIG. 7 having labels in the 300-number series are elements of the executive control 16. A complete computation cycle consisting of a first subcomputation cycle and a second subcomputation cycle is initiated when flip-flop 304 is set so that its output state is Q="1." Flip-flop 304 can be set at a request from the note detect and assignor 14 if flip-flop 320 has its output state at Q="0." As described below, flip-flop 320 is used to control a transfer cycle and it is desirable that a computation cycle not be initiated while a transfer cycle is in progress. Note detect and assignor 14 will generate a request for the start of a computation cycle if this system has detected that a keyswitch has been actuated on the musical instrument's keyboard. An alternative system operation logic is to always initiate a complete computation cycle when a transfer cycle is not in progress, or to initiate a computation cycle at the completion of each transfer of data to a note register.

When flip-flop 304 is set at the start of a computation cycle, the output state Q="1" is converted into a signal pulse, labeled RESET, by means of the edge detect circuit 305. The RESET signal is used to initialize the counters 302, 19, 303, and 322. It is also used to initialize the adder-accumulator 210.

The state Q="1" causes gate 301 to transfer clock timing signals from the master clock 15 to increment counters 302 and 19.

The RESET signal generated by the state Q="1" sets the flip-flop 325 which in turn transfers clock timing signals to increment the counter 303. Counter 303 is implemented to count modulo 32. Each time the contents of this counter is reset because of its modulo counting action, an INCR signal is generated which is used to increment the count state of the harmonic counter 20.

During the first subcomputation cycle, counter 302 counts a total of $64\times32$ master clock timing signals. When this count is reached a signal is sent to reset the flip-flop 325 and to reset the harmonic counter 20. At this time the second subcomputation cycle starts.

The state Q of the flip-flop 325 is used to operate the data select 206 as previously described in connection with FIG. 1. When Q is in state "1" the system is in the first subcomputation cycle.

When the cycle counter advances another 64 counts for a total of $(64+1)\times32+64$ master clock timing signals, a signal is generated which is used to reset the flip-flop 304 thereby ending the computation cycle.

A transfer cycle request on line 41 will set flip-flop 320 if a computation cycle is not in progress as indicated by a state Q="0" from the flip-flop 304.

The number of assigned tone generators is transferred from the note detect and assignor 14 to the comparator 321. Counter 322 is incremented by the transfer cycle requests on line 41. When the count state of counter 322 is incremented to the number of assigned tone generators contained in the comparator 321, a signal is created which resets the flip-flop 320. The state Q="0" of flip-flop 320 permits the start of a new computation cycle.

The loudness scaler 207 can be implemented as an addressable memory storing a set of numbers, or scale factors. These numbers can be addressed out in response to the loudness control signal and used as multipliers to scale, or multiply, the input values such as those from the sinusoid table 24.

I claim:

1. In a musical instrument having one or more tone generators in which a plurality of data words corresponding to the amplitudes of a corresponding number of evenly spaced points defining the waveform of an audio tone are computed and in which the data words are transferred sequentially from a note register to a digital-to-analog converter at a rate proportional to the pitch of the tone being generated, apparatus for generating tones having a variable spectral content comprising;

a first means for computing transfer data values during the first subcomputation cycle of a sequence of computation cycles each comprising a first and second subcomputation cycle, a first memory means for storing said transfer data values to be thereafter read out, a second memory means for storing a master data set comprising a plurality of data points to be thereafter read out, a signal generating means for generating a control signal, a first addressing means responsive to a control signal whereby said transfer data values are read out from said first memory means and stored in said second memory means during said second subcomputation cycle, a note register means for storing data values to be thereafter read out, a data transfer means whereby said master data set is read out from said second memory means and wherein said master data points are translated in magnitude to produce a translated master data set having a zero average value which is stored in said note register means, a second addressing means for sequentially and repetitively reading out data stored in said note register means, and means for producing musical signal waveshapes from data read out from said note register means.

2. In a musical instrument according to claim 1 wherein said first means for computing transfer data values comprises;

a word counter incremented at each computation time in said first subcomputation cycle wherein said word counter counts modulo the number M of said transfer data values, modulo reset circuitry whereby a reset signal is created when said word counter returns to its initial state, a harmonic counter incremented by said reset signal wherein said harmonic counter counts modulo a preselected number N, an adder-accumulator means initialized at the start of said first subcomputation cycle for successively adding and storing the contents of said harmonic counter, a plurality of orthogonal memory means for storing values of an orthogonal function, a third addressing means whereby a member of said plurality of orthogonal memory means is selected corresponding to contents of said adder-accumulator means and whereby said values of an orthogonal function are read out from said selected orthogonal memory means in response to contents of said word counter, a coefficient memory for storing a set of harmonic coefficient values, a coefficient memory addressing means responsive to contents of said harmonic counter for addressing out harmonic coefficient values from said coefficient memory, a multiplier means for generating the multiplied product of harmonic coefficient values addressed out from said coefficient memory by the values of orthogonal functions read out from said plurality of orthogonal memory means, a means for successively algebraically summing said multiplied product with data values read out from said first memory means by said first addressing means in response to contents of said word counter during said first subcomputation cycle, and a fourth addressing means responsive to contents of said word counter whereby contents of said means for successively algebraically are stored in said first memory means.

3. In a musical instrument according to claim 2 wherein said first means for computing transfer data values further comprises;

a formant coefficient means for storing a set of formant coefficient values, a formant clock for providing a sequence of formant timing signals, a comparator means responsive to said formant timing signals wherein formant addressing signals are generated, a formant addressing means wherein formant coefficient values are read out of said formant coefficient means in response to said formant addressing signals, and a formant multiplier means interposed between said coefficient memory and said multiplier means wherein said coefficient values read out of said formant coefficient means are multiplied by said harmonic coefficient values addressed out from said coefficient memory and wherein the multiplied values are provided to said multiplier means.

4. In a musical instrument according to claim 3 wherein said formant coefficient means comprises circuitry for computing values of said formant coefficients responsive to said formant addressing signals.

5. A musical instrument according to claim 3 wherein said comparator means further comprises;

a first signal generation circuitry responsive to said sequence of timing signals and to contents q of said harmonic counter whereby an addressing signal of unit magnitude is generated if $q+u$ is not greater than a preselected constant $q_c$ and whereby an addressing signal of magnitude $q+u-q_c$ is generated if $q+u$ is greater than said constant $q_c$ and where u is an index number denoting a member of said sequence of formant timing signals.

6. A musical instrument according to claim 3 wherein said comparator means further comprises;

a second signal generation circuitry responsive to said sequence of timing signals and to contents q of said harmonic counter whereby an addressing signal of unit magnitude is generated if $q+u$ is not less than a preselected constant $q_c$ and whereby an addressing signal of magnitude $q_c-(q+u)$ is generated if $q+u$ is less than said constant $q_c$ and where u is an index number denoting a member of said sequence of formant timing signals.

7. A musical instrument according to claim 2 wherein said first addressing means comprises;

a sinusoid table storing values of the function $\cos(2\pi n/M)$ where n is a table address index number, a sinusoid addressing means for addressing data values from said sinusoid table in response to contents of said word counter, scaling circuitry wherein said data values addressed from said sinusoid table are multiplied by scale factors selected by a control signal to produce scaled data values, and transfer addressing circuitry whereby said transfer data values are read out from said first memory means is response to said scaled data values thereby generating tones having a spectral content varied by said control signal.

8. A musical instrument according to claim 1 wherein said data transfer means comprises;

2's complement circuitry for forming the binary 2's complement of data values in said master data set, division circuitry wherein output data values from said 2's complement circuitry are divided by a number equal in magnitude to the number of data values in said master data set, a second adder-accumulator means initialized at start of said computation cycle for successively adding and storing the divided output values from said division circuitry, and an adder means for adding contents of said second adder-accumulator means with master data set values read out from said second memory means thereby producing said translated master data set having a zero average value.

9. A musical instrument according to claim 7 wherein said scaling circuitry further comprises;

a scale factor memory for storing a plurality of data values comprising said scale factors, and a scale factor memory addressing means for accessing scale factors from said scale factor memory in response to said control signal.

10. A digital polyphonic tone synthesizer in which tones of variable spectral content are generated in response to control signals comprising;

a keyboard comprising a plurality of keyswitches, a plurality of tone switches wherein each setting of the tone switches corresponds to the selection of a musical tone, a means for computing transfer data values during a computation cycle of a sequence of computation cycles, a first memory means for storing said transfer data values, a signal generating means for generating a control signal, an addressing means responsive to a control signal for addressing out transfer data values from said first memory means, said transferred data values comprising a master data set, a second memory means for storing said master data set, a plurality of note register memory means, transfer means whereby master data set stored in said second memory means is read out, translated in magnitude to have a zero average value, and transferred to be stored in selected members of said plurality of note register memory means, a plurality of variable frequency clock generators, each associated with a member of said plurality of note register memory means, whereby data is addressed out of said associated note register memory means at a selected clock rate, means responsive to operation of any member of said plurality of keyswitches for setting the frequencies of said variable frequency clock generators to predetermined values assigned to said key switches, digital-to-analog converter means connected to said plurality of note register means, and means for repetitively and sequentially reading data from each of said plurality of note register means and providing data to said digital-to-analog converter means in synchronism with said associated variable frequency clock generator, whereby said digital-to-analog converter means generates a plurality of analog output signals each having a fundamental frequency determined by a selected key on said keyboard and a waveshape determined by the combination of the setting of said tone switches and the magnitude of said first control signal.

11. A musical instrument according to claim 10 wherein said means for computing transfer function values comprises;

a formant coefficient means for storing a set of formant coefficient values, a formant clock for providing a sequence of formant timing signals in response to a formant control signal, a comparator means responsive to said sequence of formant timing signals and a comparator control signals wherein a formant addressing signal is generated, a formant addressing means whereby a formant coefficient value is addressed out from said formant coefficient means in response to said formant addressing signal, a coefficient memory for storing a set of harmonic coefficient values, a word counter incremented at each computation time in said computation cycle wherein said word counter counts modulo the number of elements in said master data set, a harmonic counter incremented each time said word counter returns to its initial state, an adder-accumulator means initialized at the start of said computation cycle, for successively adding and storing the contents of said harmonic counter, an orthogonal memory for storing values of an orthogonal function, an orthogonal function addressing means for addressing values from said orthogonal memory in response to contents of said adder-accumulator means, a coefficient addressing means for addressing harmonic coefficient values from said coefficient memory in response to contents of said harmonic counter, a formant multiplier for forming the multiplied product of harmonic coefficient values addressed out from said coefficient memory by a formant coefficient value addressed out from said formant coefficient memory means, and a multiplier means for forming the multiplied product of the value formed by said formant multiplier and a value addressed out from said orthogonal memory thereby generating said transfer data words.

* * * * *

UNITED STATES PATENT AND TRADEMARK OFFICE

CERTIFICATE OF CORRECTION

PATENT NO. : 4,300,434

DATED : November 17, 1981

INVENTOR(S) : Ralph Deutsch

It is certified that error appears in the above-identified patent and that said Letters Patent are hereby corrected as shown below:

Column 14, line 64 change "is" to --in--.

Column 15, line 32 after "computing" insert --in response to said plurality of tone switches,--.

Signed and Sealed this

Second Day of February 1982

[SEAL]

Attest:

GERALD J. MOSSINGHOFF

Attesting Officer

Commissioner of Patents and Trademarks